US009803521B2

(12) United States Patent
D'Epiro

(10) Patent No.: US 9,803,521 B2
(45) Date of Patent: Oct. 31, 2017

(54) METHOD FOR CONTROLLING A PISTON COOLING CIRCUIT OF AN INTERNAL COMBUSTION ENGINE OF AN INDUSTRIAL VEHICLE

(71) Applicant: FPT Industrial S.P.A., Turin (IT)

(72) Inventor: Clino D'Epiro, Alpignano (IT)

(73) Assignee: FPT INDUSTRIAL S.P.A., Turin (IT)

( * ) Notice: Subject to any disclaimer, the term of this patent is extended or adjusted under 35 U.S.C. 154(b) by 363 days.

(21) Appl. No.: 14/394,723

(22) PCT Filed: Apr. 17, 2013

(86) PCT No.: PCT/EP2013/057981

§ 371 (c)(1),
(2) Date: Oct. 15, 2014

(87) PCT Pub. No.: WO2013/156519

PCT Pub. Date: Oct. 24, 2013

(65) Prior Publication Data

US 2015/0047581 A1 Feb. 19, 2015

(30) Foreign Application Priority Data

Apr. 17, 2012 (EP) ..... 12164392

(51) Int. Cl.
*F01M 1/08* (2006.01)
*F01M 1/14* (2006.01)
(Continued)

(52) U.S. Cl.
CPC ..... *F01M 1/08* (2013.01); *F01M 1/02* (2013.01); *F01M 1/14* (2013.01); *F01P 3/06* (2013.01); *F01M 2001/083* (2013.01)

(58) Field of Classification Search
CPC .. F01M 1/08; F01M 1/02; F01M 1/14; F01M 2001/083; F01P 3/06; F01P 2007/146; F01P 7/16; F01P 3/10; F01P 3/12; F01P 3/20; F01P 11/08; F01P 2060/04; F01P 2003/006
(Continued)

(56) References Cited

U.S. PATENT DOCUMENTS 1,996,817 A * 4/1935 Mack ..... F01M 1/08 184/6.8
4,936,417 A * 6/1990 Groddeck ..... F01M 1/16 184/18
(Continued)

FOREIGN PATENT DOCUMENTS

| | | |
|---|---|---|
| DE | 3543084 A | 6/1986 |
| GB | 2431219 A | 4/2007 |
| JP | 59120712 | 7/1984 |

*Primary Examiner* — Thomas Moulis
*Assistant Examiner* — John Bailey
(74) *Attorney, Agent, or Firm* — Stetina Brunda Garred and Brucker

(57) ABSTRACT

The present invention refers to a method for controlling a piston cooling circuit of an internal combustion engine wherein said circuit comprises at least a circulation pump and means for emitting cooling oil connected to the delivery of the pump. According to the method, said pistons are cooled by a jet generated by said emitting means only during the upward stroke of said pistons from the bottom dead center to the top dead center.

14 Claims, 5 Drawing Sheets

(51) Int. Cl.
*F01M 1/02* (2006.01)
*F01P 3/06* (2006.01)

(58) Field of Classification Search
USPC ..... 123/41.08, 41.31, 41.33, 41.35, 41.42, 123/41.44, 41.36, 41.38, 41.39
See application file for complete search history.

(56) References Cited

U.S. PATENT DOCUMENTS 5,331,928 A * 7/1994 Wood ..... F02B 75/044 123/78 B
9,010,296 B2 * 4/2015 Teshima ..... F02B 23/104 123/193.4
9,334,766 B2 * 5/2016 Mordukhovich ..... F01M 1/08
9,410,509 B2 * 8/2016 Roth ..... F02M 31/042
9,453,439 B2 * 9/2016 Bidner ..... F01M 1/08
2003/0041815 A1 * 3/2003 Kawakubo ..... F01M 1/08 123/41.35
2004/0055545 A1 * 3/2004 Baldwin ..... F01M 1/08 123/41.35
2005/0120982 A1 * 6/2005 Ducu ..... F01P 7/16 123/41.08
2006/0243226 A1 * 11/2006 Bontaz ..... F01M 1/08 123/41.35
2009/0044768 A1 * 2/2009 Aryan ..... F01P 3/08 123/41.35
2009/0229561 A1 * 9/2009 Yamashita ..... F01M 1/16 123/196 R
2010/0031917 A1 * 2/2010 Abe ..... F01M 1/08 123/197.2
2010/0037839 A1 * 2/2010 Aixala ..... F01M 1/08 123/41.35
2011/0224883 A1 * 9/2011 Bruno ..... F01M 1/08 701/102
2011/0276249 A1 * 11/2011 Argolini ..... F01M 1/08 701/102
2011/0283968 A1 * 11/2011 Anderson ..... F01M 1/08 123/196 R
2011/0297119 A1 * 12/2011 Huhn ..... F01M 1/16 123/196 A
2012/0048228 A1 * 3/2012 Chung ..... F01M 1/08 123/196 R
2012/0132172 A1 * 5/2012 Kobayashi ..... F01M 1/08 123/196 R
2012/0138010 A1 * 6/2012 Ulrey ..... F01M 1/08 123/196 R
2012/0285401 A1 * 11/2012 Quiring ..... F01P 7/14 123/41.08
2013/0160724 A1 * 6/2013 Yamamoto ..... F01M 1/08 123/41.35
2013/0192545 A1 * 8/2013 Bidner ..... F01M 1/08 123/41.15

* cited by examiner

| Engine Speed [rpm] | Pump Flow [l/min] | Engine Flow [l/min] | ByPass Flow [l/min] | Single Piston Jet Flow [l/min] | 6 Jets Flow [l/min] |
|---|---|---|---|---|---|
| 800 | 64,3 | 64,3 | 0,0 | 4,88 | 29,27 |
| 900 | 71,4 | 71,4 | 0,0 | 5,42 | 32,54 |
| 1000 | 78,6 | 78,6 | 0,0 | 5,97 | 35,84 |
| 1100 | 86,8 | 86,8 | 0,0 | 6,60 | 39,57 |
| 1200 | 93,7 | 93,7 | 0,0 | 7,13 | 42,78 |
| 1300 | 99,9 | 99,9 | 0,0 | 7,59 | 45,52 |
| 1400 | 106,2 | 106,2 | 0,0 | 8,03 | 48,16 |
| 1500 | 112,4 | 112,3 | 0,1 | 8,42 | 50,52 |
| 1600 | 116,6 | 113,3 | 3,3 | 8,46 | 50,74 |
| 1700 | 122,2 | 114,8 | 7,4 | 8,52 | 51,15 |
| 1800 | 125,2 | 115,7 | 9,5 | 8,56 | 51,38 |
| 1900 | 130,2 | 117,2 | 13,0 | 8,64 | 51,83 |
| 2000 | 136,6 | 118,7 | 17,9 | 8,72 | 52,35 |
| 2100 | 139,2 | 119,3 | 19,9 | 8,75 | 52,51 |
| 2220 | 139,2 | 119,4 | 19,8 | 8,74 | 52,44 |
| 2330 | 138,8 | 119,4 | 19,5 | 8,73 | 52,37 |

| | | | | | | | | | | | | | | | | | |
|---|---|---|---|---|---|---|---|---|---|---|---|---|---|---|---|---|---|
| Input | rpm | 800 | 900 | 1000 | 1100 | 1200 | 1300 | 1400 | 1500 | 1600 | 1700 | 1800 | 1900 | 2000 | 2100 | 2220 | 2330 |
| | Jet(kg/s) | 0,390 | 0,434 | 0,478 | 0,528 | 0,570 | 0,607 | 0,642 | 0,674 | 0,677 | 0,682 | 0,685 | 0,691 | 0,698 | 0,700 | 0,699 | 0,698 |
| | Bypass(kg/s) | 0,000 | 0,000 | 0,000 | 0,000 | 0,000 | 0,000 | 0,000 | 0,002 | 0,044 | 0,099 | 0,126 | 0,174 | 0,239 | 0,265 | 0,264 | 0,260 |
| Result | Tot_Power(W) | 53,9 | 74,1 | 99,0 | 133,3 | 168,4 | 203,1 | 240,6 | 278,7 | 301,6 | 332,6 | 348,0 | 375,2 | 410,6 | 422,3 | 417,8 | 413,5 |
| Partial | Piston DRAG | 32,7 | 45,2 | 60,6 | 81,5 | 103,3 | 125,6 | 150,0 | 175,0 | 182,7 | 192,3 | 200,7 | 211,4 | 223,1 | 231,5 | 239,0 | 245,9 |
| | Recupated by oil spray on piston: COOLING | 21,2 | 28,9 | 38,4 | 51,9 | 65,1 | 77,5 | 90,6 | 103,0 | 99,6 | 97,8 | 94,8 | 93,4 | 92,5 | 89,3 | 83,9 | 79,2 |
| | BYPASS | 0,0 | 0,0 | 0,0 | 0,0 | 0,0 | 0,0 | 0,0 | 0,7 | 19,3 | 42,4 | 52,5 | 70,4 | 94,9 | 101,5 | 94,9 | 88,4 |

Fig. 6

METHOD FOR CONTROLLING A PISTON COOLING CIRCUIT OF AN INTERNAL COMBUSTION ENGINE OF AN INDUSTRIAL VEHICLE

CROSS REFERENCE TO RELATED APPLICATIONS

The present application claims priority to PCT International Application No. PCT/EP2013/057981 filed on Apr. 17, 2013, which application claims priority to European Patent Priority No. 12164392.8 filed Apr. 17, 2012, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention belongs to the field of the manufacturing of internal combustion engine systems for vehicles, preferably industrial vehicles, commercial vehicles and/or trucks. More precisely the invention refers to a method for controlling a piston cooling circuit of an internal combustion engine, preferably, but not exclusively, of an industrial vehicle.

DESCRIPTION OF THE PRIOR ART

In recent years, specific horsepower delivered by piston internal combustion engines has more and more increased, which has resulted inevitably in an increase of the thermal loads to be sustained by the engine. The components that have to bear the highest stress in terms of thermal load are the pistons, since it is very difficult to dissipate the heat generated by the combustion. Such heat, indeed, has to pass through the compression rings which have a reduced surface and are made in a non-conductive material.

Except a few naval applications, where large bores and low speed allow water to circulate within the pistons, in most of the other applications pistons are cooled by cooling oil sprayed by some nozzles, at least one per piston of the engine.

Nozzles are dimensioned and are placed so that the jet (spray) they generate can reach the corresponding piston even when it is at its top dead center (in the following called TDC). With reference to FIG. 2, in case of diesel engines, the nozzles are shaped and are placed so that they generate a jet having a substantially "vertical" axis, namely parallel to the stroke of the piston within the cylinder. In gasoline engines, instead, the jets have a substantially inclined axis, namely not vertical, as shown in FIG. 1.

It is also known that, in diesel engines, the nozzles have to be placed precisely below the piston, since the jet should hit the piston in a specific point. FIG. 2 shows a cylinder of a diesel engine of the type known which houses a piston 3 cooled by an oil jet 7 sprayed by a cooling nozzle 10. As shown in the figure, an oil circulation gallery 19 is made in the piston 3 and defines an inlet section 19' through which the oil of the jet 7 coming from the nozzle 10 should be injected. The oil passes through such circulation gallery 19 up to an outlet section 19" and it falls back into the collecting tank below the cylinder. The gallery 19 allows the oil to circulate within the piston in order to dissipate the heat and to preserve, among other parts, the seal of the ring in the proximity of the first groove defined on the piston head. Consequently, the operating position of the nozzle 10 is very important for an efficient heat dissipation.

It has been observed that using oil spray nozzles requires, however, a certain energetic expenditure. Firstly the oil sprayed by the nozzles has to be pressurized by means of the oil circulation pump. This, of course, determines a loss in terms of power. Secondly, the heat removed from the oil increases its temperature and makes it necessary to cool the oil itself, usually by means of an oil-air or oil-water exchanger. This introduces further load losses in the oil circuit which should be overcome again by the oil circulation pump.

A further aspect is represented by the fact that in the traditional solutions, the nozzles spray oil both during the downward stroke of the pistons (namely during the stroke from the TDC to the BDC) and during the upward stroke (namely during the stroke from the BDC to the TDC). During the upward stroke, the impact of the oil on the piston facilitates the stroke of the piston itself, while during the downward stroke the piston is braked by the oil itself. From an energetic point of view, it has been observed that the energy wasted for such piston braking during the stroke from the TDC to the BDC is more than the energy recuperated during the stroke from the BDC to the TDC. In practice, during the downward stroke, the losses for the oil pressurization add to the ones for the piston braking and this energy cannot be recuperated; during the upward stroke, from the BDC to the TDC, the energy spent by the oil pump in the form of thrust to the piston is partially recuperated. The energy spent for the braking is particularly evident. During the downward stroke, indeed, the relative impact speed of the oil on the piston is defined by the algebraic sum of the speed of the piston and of the cooling oil. On the contrary, during the upward stroke, the relative impact speed is given by the difference of the two speeds (piston and oil). Considering the following formula of the kinetic energy:

$$E_k = \frac{1}{2}mv^2$$

it can be obtained that the impact energy during the piston braking exceeds the energy recuperated during the upward stroke, due to the different values of the relative impact speed v.

In some known solutions, the oil emitting nozzle is always open, whatever is the pressure in the circuit. In other known solutions, a ball valve is placed before each nozzle, opposing a spring. When the oil pressure in the intake circuit (upstream of the nozzle) exceeds a predetermined value, the ball frees the nozzle and the oil can be emitted. The ball is usually set so that it opens the nozzle at a first predetermined pressure, for example 1.7 bars, and stays constantly open as the rotation speed increases during both strokes of the piston in the cylinder (upward and downward).

The circulation pump is directly driven by the drive shaft so that its rotation speed is "multiplied" in relation to the engine rotation speed. This solution guarantees a fast pressure increase when the engine is started and when its speed is slow. It is thus evident that as such speed increases, the oil circulation pump would determine an excessive increase of the oil pressure. For this reason, a by-pass is provided in the intake circuit, suitable to release the oil overpressure before it reaches prohibitive levels. In practice, when a second predetermined pressure (for example 5 bars) is reached in the intake circuit, the bypass of the intake circuit is opened, in order to release a part of the flow rate and to maintain such second predetermined pressure value (5 bars) at the inlet of the bearings and at the outlet of the nozzle. All in all, in most of the known solutions, the oil emitting nozzles are almost always open, except for the initial starting steps, when the engine rotation speed is relatively low. It is evident, however, that the pressure release of the by-pass represents an energy, and thus a power, loss.

In the most recent solutions, the ball valve is replaced by a cut-in/cut-off valve, namely an electric valve which controls all the nozzles simultaneously. The opening/closing of the valve is actuated as a function of the load of the shaft and as a function of the speed of rotation. In practice the valve is controlled by a control unit which, according to a predetermined map, opens and closes the nozzles as a function of the operating conditions of the engine (load and rpm). In particular, in conditions of low rpm and of low load, the electric valve keeps the nozzles closed. In such conditions, since the cooling oil does not act on the piston, no resistance is exerted during the downward stroke, and at low speeds of rotation a power (energy) saving occurs that reduces the emissions. Actually, during this step, the oil cannot exert even the possible thrust effect on the pistons during the upward stroke. Such effect, however, as explained above, is lower than the braking contribution. In practice, the cut-in/cut-off electric valve actually allows to save energy with low speeds of rotation, but in fact it is useless with high speeds of rotation or with higher loads.

It has been observed that, during the usual operating conditions of an industrial vehicle, the cut-in/cut-off valve is almost always open, and thus the nozzles work all the time during both the strokes of the pistons (thrust and traction). Consequently the use of the cut-in/cut-off valve is actually advantageous only in the field of vehicle type tests, which are usually performed over a combined cycle, where the urban cycle is prevalent and thus the average engine load is substantially limited. During these tests, the engine speed is kept near the idling and thus the piston has no need to be cooled. The fact that the nozzles are not activated at such engine speeds (cut-in/cut-off valve closed) has a great impact in terms of energy saving at the starting (cold engine), since the pistons are not braked by the cooling oil. This, of course, results in a reduction of carbon dioxide emissions. In fact, during the normal operating conditions of the vehicle, fuel consumption is 30-40% higher, since there is the constant need for cooling the engine, namely for keeping the cut-in/cut-off valve open.

From these considerations, the need for an alternative technical solution, allowing to overcome the aforementioned limits and the drawbacks of the prior art, emerges. In particular, the need for limiting the energetic expenditure associated to the cooling of the pistons and to the circulation of the oil used for such cooling is evident.

SUMMARY OF THE INVENTION

The main task of the object of the present invention is to provide a method for controlling a piston cooling circuit which allows to overcome the drawbacks set forth above. In the scope of this task, a first aim of the present invention is to provide a method which allows a reduction of the energetic expenditure that is necessary for the distribution of the cooling oil.

Another aim of the present invention is to provide a method that allows to increase the overall efficiency of the internal combustion engine where the cooling circuit is installed. Not least, the purpose of the present invention is to provide a method which is reliable and easy to perform with competitive costs.

This task and these aims are reached by means of a method according to what indicated in Claim 1. Further aspect of the method according to the invention are indicated in the dependent claims.

The control method according to the invention provides a cooling oil emission only during the upward stroke of the pistons, from the bottom dead center (in the following BDC) to the top dead center (in the following TDC). This allows to recuperate about half of the work that is necessary to compress the oil. This recuperation is summed to the work that is no longer wasted during the downward stroke of the piston. Such results are reached without losing any efficiency in terms of cooling, since the quantity of oil emitted during the upward stroke of the pistons is overall equal to the one traditionally emitted during a whole cycle of the piston in the cylinder, the term "cycle" referring to two subsequent strokes (namely an upward stroke from the BDC to the TDC an a subsequent downward stroke from the TDC to the BDC).

LIST OF THE FIGURES

Further characteristics and advantages will become more evident from the following detailed description of embodiments of the control method according to the present invention, that is shown in the attached drawings wherein.

FIGS. 4, 5, 6 and 7 refer to a calculation model which demonstrates the advantages, in terms of power recuperation, of the control method according to the present invention.

DETAILED DESCRIPTION OF THE INVENTION

Figure 1:
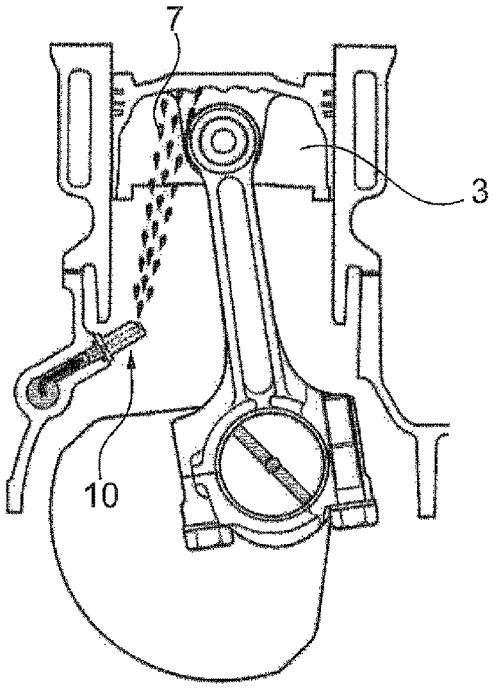
FIG. 1 shows a schematic view of a cylinder of a gasoline internal combustion engine of the type known in the art.
Figure 2:
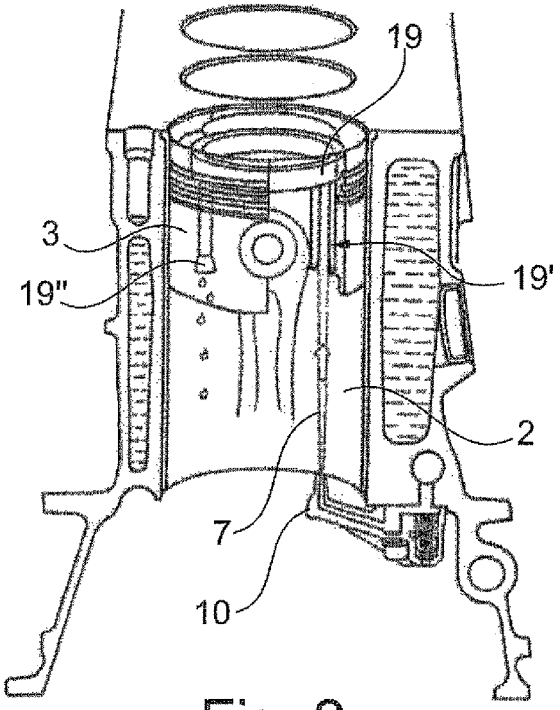
FIG. 2 shows a schematic view of a cylinder of a diesel internal combustion engine of the type known in the art.
Figure 3:
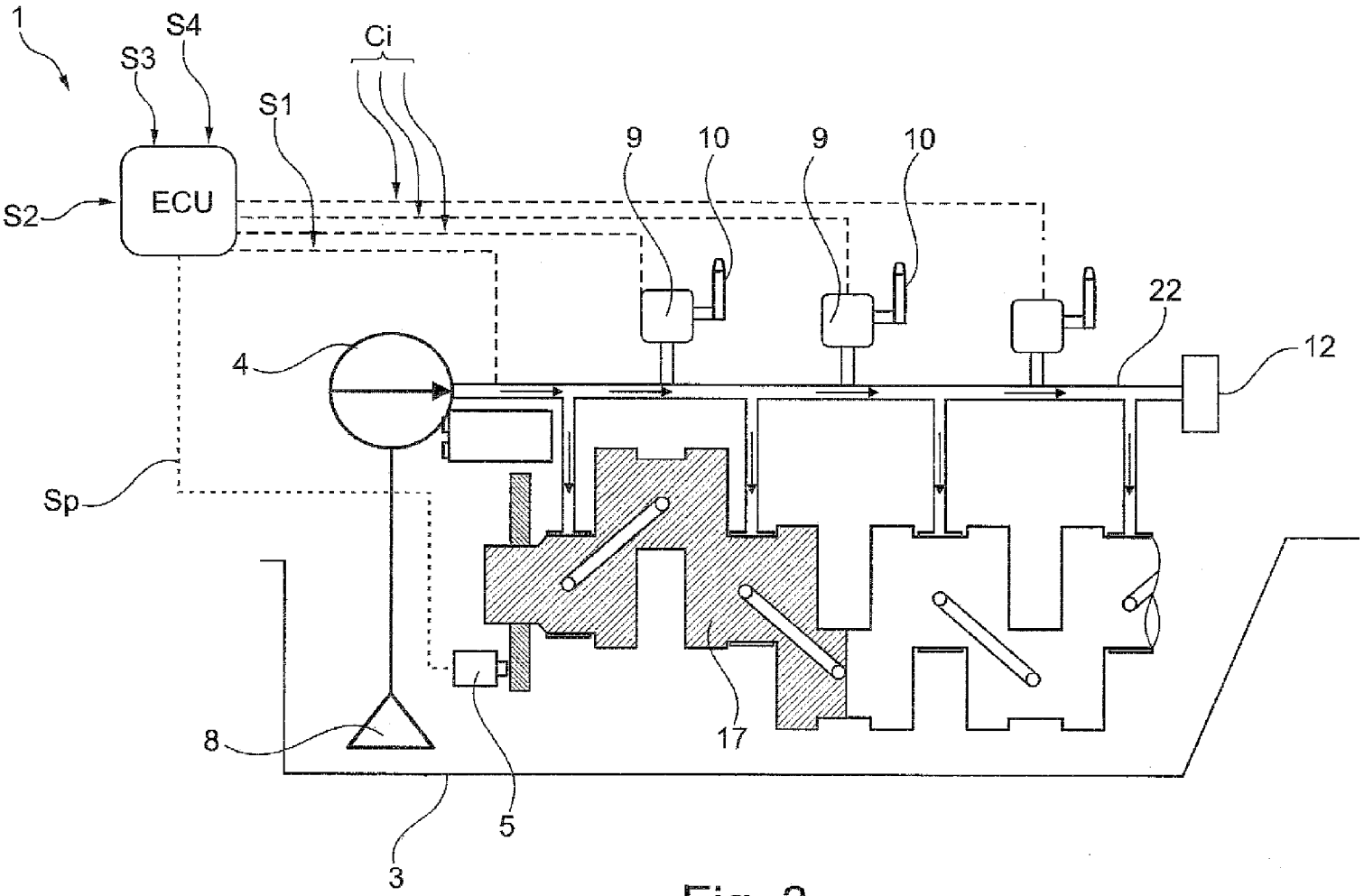
FIG. 3 shows a schematization of a circuit to which the method according to the present invention can be applied.

The present invention thus refers to a method for controlling a piston cooling circuit of an internal combustion engine and to a cooling circuit where such method is applied. On this point, FIG. 3 shows a schematic view of a cooling circuit 1 according to the invention, intended, in particular, to cool the pistons of a diesel engine. The circuit according to the invention, however, may be used for the same purposes also in a gasoline engine.

The cooling circuit 1 comprises a circulation pump 4 for pumping oil from the sump 3 of the engine by means of a draft device 8 connected to the suction of the pump itself. In a first alternative embodiment, the pump 4 may be directly connected to the shaft of the combustion engine, so that the oil flow rate of the pump, and thus the delivery oil pressure depends directly on the speed of rotation of the drive shaft. In an alternative embodiment, the pump 4 may also be of the variable flow rate type. Compared to the previous one, such solution allows to obtain a delivery pressure that does not depend on the speed of rotation of the drive shaft.

Circuit 1 according to the present invention further comprises means for emitting the oil, which emit a jet of cooling oil intended to hit the pistons of the internal combustion engine. In particular, according to the invention such emitting means are activated only during the upward stroke of the pistons, from the bottom dead center (BDC) to the top dead center (TDC). In practice, according to the method of the invention the jet of oil intended to cool the pistons is emitted only during their upward stroke, namely during the stroke from the bottom dead center to the top dead center. Consequently, according to the present invention, during the downward stroke of the pistons (namely during the stroke from the TDC to the BDC), the means for emitting the oil are deactivated and thus they do not generate any cooling jet towards the pistons themselves.

The method according to the present invention is thus very different from the known solutions, wherein, as explained above, the cooling oil is emitted during both strokes (upward and downward) of a cycle of a piston within the cylinder. On this point, it has been observed that, compared to the traditional solutions, the method according to the invention allows to reduce the work that is necessary to compress the oil in the cooling circuit of about 50%.

Such reduction has to be summed to the lack of braking actions on the piston during the downward stroke towards the BDC, which usually affects the traditional solutions. In general, it has been observed that, considering the efficiency losses due to the load losses in the intake ducts between pump and nozzles, the method according to the present invention allows to recuperate anyway, compared to the traditional solutions, the energy spent for pumping the oil from the nozzles.

The means for emitting the cooling oil comprise a plurality of nozzles 10, each one of them is intended to cool a correspondent piston. From an operating point of view, the nozzles 10 are placed below the piston according to an installation mode per se known. The means for emitting the cooling oil further comprise a plurality of valves 9 which activate/deactivate the delivery of the cooling oil. Each one of these valves 9 has the function to allow/stop the delivery of cooling oil by means of a corresponding nozzle 10. According to a possible embodiment, the valves 9 may be solenoid valves, for example of the type used for injecting liquid fuel in the intake manifolds of the controlled ignition engines. Alternatively, the activation/deactivation valves 9 may be manually, electrically, or pneumatically activated. The emitting means indicated above are controlled by a control unit, which is preferably integrated in the main ECU (Electronic Control Unit) of the engine, which collects the signals, generated by the different sensors, that are characteristics of the operating conditions of the engine. In particular, the control unit (indicated by ECU in FIG. 3) has the function of activating/deactivating each valve 9 firstly as a function of the "stroke" (upward or downward) of the corresponding piston. On this point, the control unit ECU is connected to each valve 9, so that it can generate corresponding signals (indicated by Ci in FIG. 3) suitable to activate/deactivate each valve 9, in order to allow/stop the oil delivery.

Considering, for example, a six-cylinder internal combustion engine, as it is known in the art, when three pistons perform an upward stroke, the other three pistons perform a downward stroke. Thus, in such condition, the control unit commands the activation of the three valves corresponding to the three pistons performing an upward stroke and their respective three nozzles will be activated, while it deactivates the three valves corresponding to the three pistons performing a downward stroke, whose nozzles 10 will be deactivated. As schematized in FIG. 3, the strokes of the pistons (upward and downward) are detected by a stroke sensor 5 (which for example reads a phonic wheel) which detects the angular position of the engine crankshaft 7 and transmits a corresponding signal Sp to the control unit ECU.

According to the present invention, the control unit of the emitting means calculates, as a function of the engine operating parameters, a minimum flow rate of cooling oil that has to be overall delivered to each piston by the emitting means themselves during the respective upward stroke. The expression "minimum flow rate" of the oil refers to a flow rate that is sufficient to ensure the cooling of the piston during a whole cycle within the cylinder, the term "cycle" meaning an upward stroke and a subsequent downward stroke of the piston itself. In particular, such minimum flow rate is calculated at least as a function of the speed of rotation of the drive shaft and/or as a function of the load conditions of the engine itself. It can be observed that, being the operating conditions and the engine equal, the value of the instant minimum flow rate mentioned above will be twice the flow rate that is usually delivered in the traditional solutions during the upward stroke only. As a consequence, the present invention allows to recuperate an amount of energy twice the amount of the traditional solutions during the upward stroke.

In a preferred embodiment of the invention, the control unit ECU calculates the value of the minimum flow rate indicated above also as a function of the absolute pressure and of the temperature of the oil within the cooling circuit. The absolute pressure is detected by a respective sensor which generates a corresponding input signal (indicated by S1 in FIG. 3) in the control unit. In an alternative embodiment, the control unit ECU might calculate the value of the minimum flow rate also as a function of the intake pressure of the air within the pistons.

The control unit according to the invention calculates, as a function of such minimum flow rate, the minimum activation time of the emitting means, that is enough to allow the delivery of the minimum flow rate during the upward stroke of the pistons. The expression "minimum activation time" refers to the interval of time wherein the emitting means have to maintain their activation mode in order to allow the delivery of the minimum flow rate of cooling oil. On this point it can be observed that the control unit ECU calculates such minimum activation time as a function of the flow rate of the circulation pump 4 of the cooling oil in the circuit.

According to a first possible actuation mode, the means for emitting cooling oil are configured so that they can emit, during the minimum activation time, a jet having a variable flow rate. According to this operating mode, the nozzles have a continuously variable section during the activation period calculated by the control unit ECU (namely during the stroke from BDC to TDC).

In an alternative and preferred actuation mode, the emitting means are configured so that they emit, during the calculated minimum activation time, a jet having a fixed flow rate substantially defined by a constant section of the corresponding nozzles 10.

In both the actuation modes (jet having a fixed flow rate or a variable flow rate) the product of instant flow rate and opening time gives the quantity of oil that is necessary to cool the pistons, calculated by the control unit from the engine operating parameters.

As shown in FIG. 3, and as previously mentioned, the circuit according to the invention comprises at least a first pressure sensor operatively connected with the control unit ECU in order to send a signal (indicated by S1 in FIG. 3) characteristic of the actual pressure value of the oil circulating in the circuit between the delivery of the circulation pump and the emission means. Further sensors are placed to measure further engine operating parameters from which the control unit ECU calculates the value of the minimum flow rate needed to cool the pistons as mentioned above. On this point, the circuit 1 may comprise a temperature sensor, to detect the oil temperature within the cooling circuit and/or a pressure sensor to detect the pressure of the intake air within the cylinders. In general these sensors generate the signals (indicated by S2, S3, S4) that are sent (together with the signal S1) to the input of the control unit ECU as input data for calculating the oil flow rate needed for cooling the pistons.

In particular, according to the method of the invention, said emitting means are deactivated, regardless of the operating stroke (upward, downward) of the pistons, when such actual pressure value between said pump 4 and said emitting means is lower than a first predetermined value.

More precisely, when the actual oil pressure value between the pump and the emitting means is lower than said first predetermined value, the control unit keeps the nozzles 10 in deactivated position, thus blocking the oil delivery. On the contrary, when such first predetermined value is exceeded, then the control unit ECU commands the activation of the emitting means, namely it commands the activation of the nozzles 10 and allows the delivery of the necessary quantity of cooling oil.

In a preferred embodiment, when the actual oil pressure between the pump delivery 4 and the emitting means exceeds a second predetermined value (higher than the first predetermined value), then the control unit ECU calculates a an exceeding flow rate value of the oil, that is characteristic of the difference between the actual pressure value and such second predetermined value.

From this exceeding flow rate value, the control unit ECU calculates a second activation time of the emitting means that is sufficient to allow, always and only during the upward stroke of the pistons, the emission of an "overall flow rate" of oil, given by the sum of minimum flow rate and exceeding flow rate. The control unit ECU thus commands the activation of the emission means for a period of time corresponding to said second activation time.

In other words, according to the invention, when the actual pressure value exceeds a second predetermined value, the excess of overpressure is delivered by the emitting means, namely it is used for cooling the pistons and to increase their thrust during the upward stroke. Thus, according to this solution, the exceeding pressure is not discharged by a by-pass circuit, as in the traditional solutions, but it is advantageously recuperated for pushing the pistons.

From a thermal point of view, the emission of an overall flow rate of cooling oil that is higher than the minimum one allows to advantageously increase the dissipation of the thermal load on the piston.

Figures 4, 5:
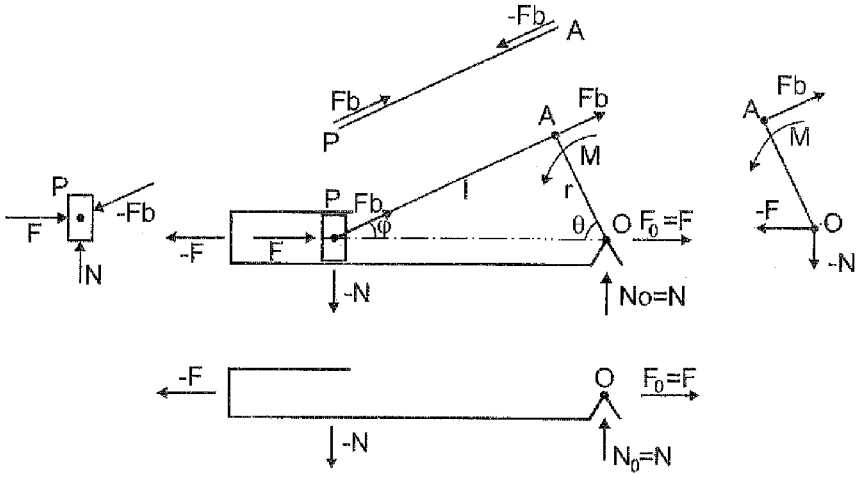

In the following, reference is made to FIGS. 4, 5, 6*e* 7 referring to a calculation model which demonstrates the advantages, in terms of power recuperation, of the control method according to the present invention. The table of FIG. 4 collects the starting data used for calculating the relative impact speed between the cooling oil coming from the emitting means and the pistons. In particular, a six-cylinder engine is considered, with a cooling circuit of the type known in the art comprising a by-pass circuit. The table of FIG. 4 shows, as a function of the engine speed of rotation [Engine Speed], the oil flow rate of the pump [Pump Flow], the flow rate addressed to the engine as a whole [Engine Flow], the latter corresponding not only to the oil flow rate intended to cool the nozzles, but also the oil flow rate intended to reach other parts of the engine, such as the bearings of the crankshaft. On this point, it is possible to observe in FIG. 3 that the main line 2 of the hydraulic circuit on the one hand feeds the nozzles 10 for cooling the pistons and on the other hand feeds the bearings of the crankshaft 7.

The table of FIG. 4 shows also the flow rate discharged by the by-pass [By-Pass Flow], the flow rate passing through a single nozzle (intended to cool a single piston) and the overall flow rate passing through all the nozzles (intended to cool all the pistons). Supposing to use emitting means configured in order to deliver cooling jets with variable opening angle, namely by means of constant-area nozzles, the output speed of the cooling oil coming from the nozzles has been calculated. The output speed of the cooling oil is algebraically summed to the speed of the piston during its downward stroke (from TDC to BDC). Considering the diagram of FIG. 5, the piston speed may be calculated by the formula:

$$v_P = \omega r\left(sen\theta + \frac{r}{2l}sen2\theta\right)$$

wherein ω is the engine speed, r is the radius of the crank and θ is the angular position of the crank. The impact energy transferred by the oil to the piston has been calculated by the kinetic energy formula that follows:

$$E_k = \frac{1}{2}mv^2$$

wherein V is the relative speed of impact between piston and oil. During the downward stroke, such relative speed of impact is given by the algebraic sum of the speed of the piston and of the cooling oil. On the contrary, during the upward stroke, the two considered speeds have to be subtracted, thus the impact speed during the upwards stroke will be lower than the one during the downward stroke.

By dividing the value of such energy by the area of the piston, it is possible to calculate the force F applied on the piston and from that it is possible to calculate also the moment of the drive shaft by means of the formula:

$$M = Fr\left(sen\theta + \frac{r}{2l}sen2\theta\right)$$

From the calculation formula of the moment, it is possible to calculate the work and thus the power transferred to the piston during the upward and the downward stroke.

The results of such calculations are shown in the table of FIG. 6. In particular, such table comprises a first section called "Input" wherein the corresponding lines show the starting data divided into three lines, the first of which is related to the possible speeds of rotation of the engine. For each of such speeds, the second line shows the corresponding flow rate of cooling oil delivered by the nozzles [Jet Flow], while the third line shows the respective oil flow rate discharged by the by-pass. On this point, it can be observed that such flow rate discharged by the by-pass is substantially equal to zero until the engine speed exceeds a certain value (in particular 1550 rpm).

The table of FIG. 6 comprises a middle section called "Result" which, for each column of the section "Input", shows the overall power recuperated by the actuation of the method and circuit according to the invention. Finally, the table comprises a third section called "Partial" which, for each column of the section "Result" shows the different contributions relating to the overall power connected to the strokes of the pistons (upward/downward) and to the presence of the bypass. In particular, the line called "Piston Drag" indicates the recuperated power fraction corresponding to the one "lost" in the traditional solutions due to the braking action of the oil during the downward stroke of the piston. The line "Recuperated by oil spray on piston" indicates the power fraction recuperated by the thrust action of the oil during the upward stroke, while the line called "By-Pass" indicates the power fraction that can actually be recuperated from the flow that is usually addressed to the by-pass, namely the power that would be usually lost by the by-pass itself.

Thus, considering the data of table 6, it can be observed that according to the method and the circuit of the invention, the emission of cooling oil during the upward stroke itself advantageously avoids a power loss during the downward stroke (braking) of the piston. At the same time, during the upward stroke (thrust) of the piston, a part of the power used for pumping the oil is advantageously recuperated.

Furthermore, as indicated above, the control method allows to deliver a flow rate that is sufficient to cool the piston during a whole cycle in the cylinder (namely a downward stroke and a subsequent upward stroke). This means that during the upward stroke it would be possible to recuperate a higher quantity of energy than the one usually transferred, during the same stroke, in the traditional solutions.

This means that, according to the present invention, it is possible to recuperate also the power fraction that is usually lost by the by-pass circuit when the engine speed exceeds 1500 rpm. In this condition, as indicated above, the method according to the present invention emits an oil flow rate given by the sum of the minimum flow rate needed for the cooling and of an exceeding flow rate characteristic of the overpressure due to the high speed of rotation.

Figure 7:
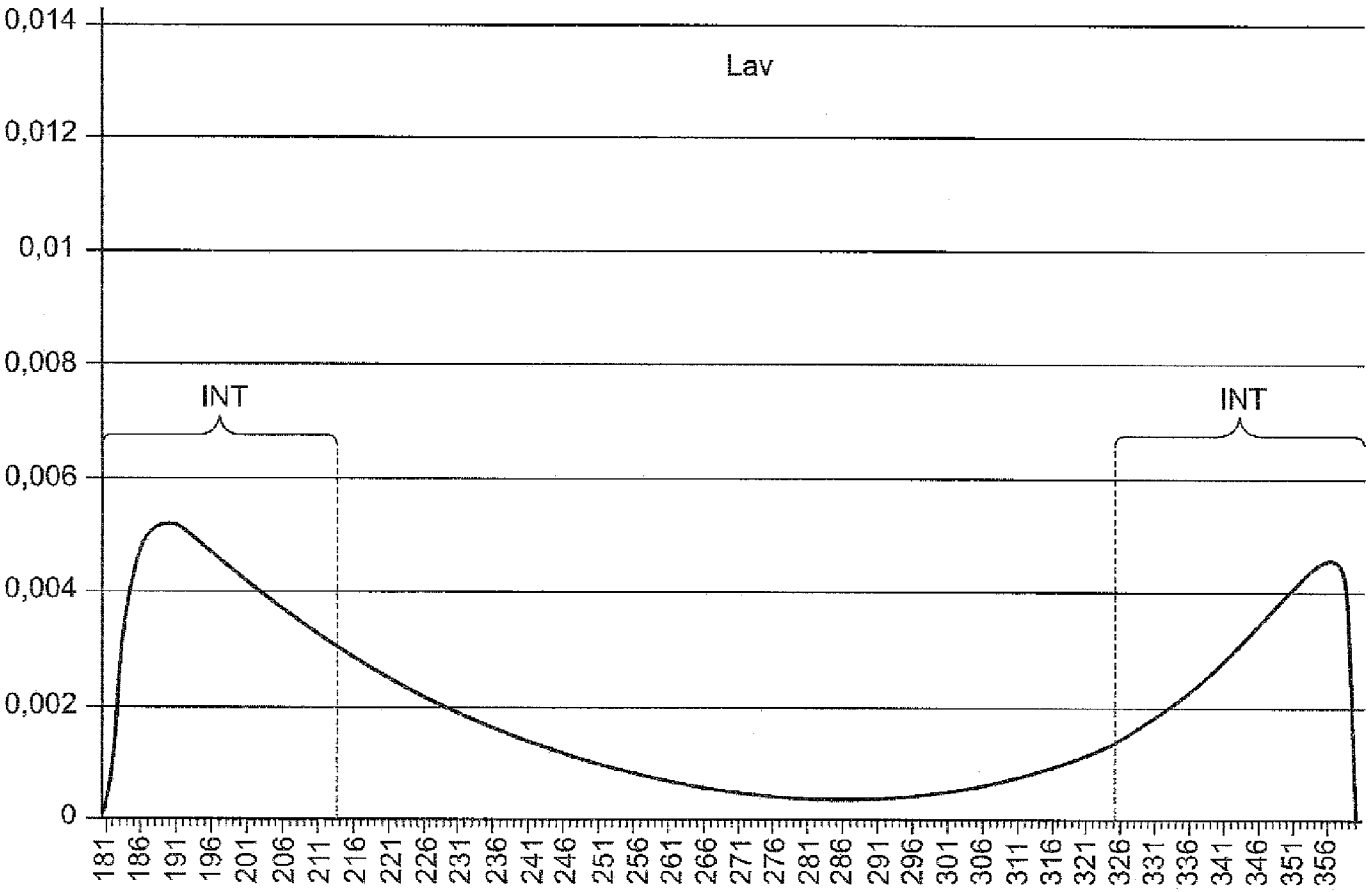

The diagram of FIG. 7 shows the work Lay performed by the cooling oil emitted by each nozzle 10 on a corresponding piston. In the diagram, in particular, the work curve Lay is plotted as a function of the position reached by the piston during the upward stroke. Such position is identified by the crank angle θ indicated in FIG. 5.

As shown by the diagram of FIG. 7, the work Lay varies as a function of the position reached by the piston during the upward stroke towards the TDC, reaching the maximum values when the piston occupies a position near the BDC and the TDC, and the minimum values when the piston is near the middle of the stroke.

In view of the trend of the work curve Lay it is advantageously possible to implement the control method of the cooling circuit indicated above. In particular, the flow rate of the cooling oil (both the "minimum flow rate" or the "overall flow rate", depending on the cases) may be advantageously delivered as a function of the position of the pistons during the upward stroke.

For example, if variable section nozzles are used, then such section may be varied in order to increase the oil flow rate delivered when the piston gets closer to the TDC and to the BDC and to decrease such flow rate when the piston passes near the middle part of the upward stroke. In other words, near the TDC and the BDC the flow rate delivered is higher than the one delivered near the middle part of the upward stroke.

In case of constant flow rate nozzles, during each upward stroke of the pistons, the nozzles 10 may be activated for two short intervals of time (activation interval), each one corresponding to the passage of the piston in an interval (indicated by INT in FIG. 7) between the positions near the TDC or the BDC. In other words, according to this mode, the nozzles 10 are not activated during the whole upward stroke of the piston from the BDC to the TDC, but only during the initial and the end part of such upward stroke (interval INT). Always according to the latter hypothesis, the section of the nozzles 10, must be higher than the one used for the delivery during the whole upward stroke, in order to allow the delivery of the oil flow rate only in the two activation intervals indicated above.

The control method according to the invention allows to fulfil the purposes set forth above. In particular the method allows to reduce the overall energy that is necessary to cool the pistons and to increase, in the final analysis, the engine efficiency. The control method according to the invention can be subjected to numerous variations or modifications, without departing from the scope of the invention; moreover all the details may be replaced by others that are technically equivalent.

The invention claimed is:

1. A method for controlling a cooling circuit of the pistons of an internal combustion engine, said circuit comprising a circulation pump and a plurality of nozzles for emitting cooling oil connected to the output of said circulation pump and suitable to generate a cooling jet intended to hit said pistons, said method comprising the step of generating said jet only during the upward portion of the stroke of said pistons, the upward portion of the stroke including the movement of the pistons from the bottom dead center (BDC) to the top dead center (TDC).

2. The method according to claim 1, comprising the steps of:

calculating, as a function of the operating parameters of said engine, a minimum flow rate of cooling oil that has to be delivered overall by said plurality of nozzles during said upward stroke of said pistons;

calculating a first minimum activation time of said plurality of nozzles that is sufficient to allow the emission of said minimum flow rate during said upward stroke.

3. The method according to claim 1, comprising the steps of:

detecting the actual pressure value of said cooling oil circulating in said circuit between said circulation pump and said plurality of nozzles;

deactivating said plurality of nozzles when the pressure of said cooling oil circulating between said pump and said plurality of nozzles is lower than a first predetermined value.

4. The method according to claim 2, comprising the steps of:

detecting the actual pressure value of said cooling oil circulating in said circuit between said circulation pump and said plurality of nozzles;

deactivating said plurality of nozzles when the pressure of said cooling oil circulating between said pump and said plurality of nozzle is lower than a first predetermined value.

5. The method according to claim 3, wherein when said actual pressure value exceeds a second predetermined value higher than said first predetermined value, said method comprises the steps of:

calculating an exceeding flow rate value of cooling oil characteristic of the difference between said actual value and said second predetermined value;

calculating a second activation time of said plurality of nozzles that is sufficient to allow the emission, during said upward stroke, of an overall flow rate given by the sum of said minimum flow rate and of said exceeding flow rate;

activating, during said upward stroke, said plurality of nozzles for a time corresponding to said second activation time.

6. The method according to claim 4, wherein when said actual pressure value exceeds a second predetermined value higher than said first predetermined value, said method comprises the steps of:

calculating an exceeding flow rate value of cooling oil characteristic of the difference between said actual value and said second predetermined value;

calculating a second activation time of said plurality of nozzles that is sufficient to allow the emission, during said upward stroke, of an overall flow rate given by the sum of said minimum flow rate and of said exceeding flow rate;

activating, during said upward stroke, said plurality of nozzles for a time corresponding to said second activation time.

7. The method according to claim 1, wherein said plurality of nozzles emit said overall flow rate of cooling oil by a constantly open jet and/or by a variable flow rate jet and by a fixed activation time.

8. The method according to claim 2, wherein said minimum flow rate of cooling oil is delivered, during said upward stroke of said piston, in a variable way as a function of the position of said pistons.

9. The method according to claim 8, wherein in the proximity of said top dead center (TDC) and of said bottom dead center (BDC) the flow rate of cooling oil that is delivered is higher than the one delivered in the proximity of the middle part of said upward stroke.

10. The method according to claim 8, wherein said minimum flow rate of cooling oil is delivered, for each upward stroke, in two intervals of time, each corresponding to the passage of said pistons in an interval of positions (INT) near the top dead center (TDC) or the bottom dead center (BDC).

11. A cooling circuit for cooling pistons of an internal combustion engine characterized in that it comprises a plurality of nozzles for emitting cooling oil which generate a jet of cooling oil intended to hit each one of said pistons only during the upward stroke of said pistons from the bottom dead center (BDC) to the top dead center (TDC), the plurality of nozzles in fluid communication with a pump; and a plurality of activation/deactivation valves (9), located in between the plurality of nozzles and the pump, the valves in fluid communication with both the plurality of nozzles and the pump, and each one of the valves being associated to a corresponding nozzle in order to allow its activation/deactivation.

12. The circuit according to claim 11, wherein said circuit comprises a control unit (ECU) for controlling said plurality of valves (9) of said plurality of nozzles.

13. The circuit according to claim 11, wherein said valves (9) of the electromechanical, electric, mechanical or pneumatic type.

14. The circuit according to claim 12, wherein said valves (9) of the electromechanical, electric, mechanical or pneumatic type.

* * * * *